United States Patent [19]

Irish

[11] 4,406,120

[45] Sep. 27, 1983

[54] CATALYST OVER TEMPERATURE PROTECTOR

[75] Inventor: David C. Irish, Livonia, Mich.

[73] Assignee: Ford Motor Company, Dearborn, Mich.

[21] Appl. No.: 280,761

[22] Filed: Jul. 6, 1981

[51] Int. Cl.[3] ..... F01N 3/22

[52] U.S. Cl. ..... 60/284; 60/289

[58] Field of Search ..... 261/39 E; 60/284, 289

[56] References Cited

U.S. PATENT DOCUMENTS 3,106,820 10/1963 Schaffer ..... 60/284
3,919,843 11/1975 Arnaud ..... 60/289
3,986,352 10/1976 Casey ..... 60/284
4,050,427 9/1977 Hollins ..... 261/39 E
4,352,346 10/1982 Osano ..... 261/39 E

*Primary Examiner*—Douglas Hart
*Attorney, Agent, or Firm*—Robert E. McCollum; Clifford L. Sadler

[57] ABSTRACT

An engine carburetor automatic choke includes a heater to warm the choke bimetallic coiled spring to effect choke come-off faster than by the normal warm-up of the spring in response to ambient temperature rise, the heater being activated upon operation of a bimetallic switch upon the attainment of a predetermined temperature level, the switch also controlling energization of an electrical control to control the operation of a gas conversion device such as a catalytic converter.

5 Claims, 1 Drawing Figure

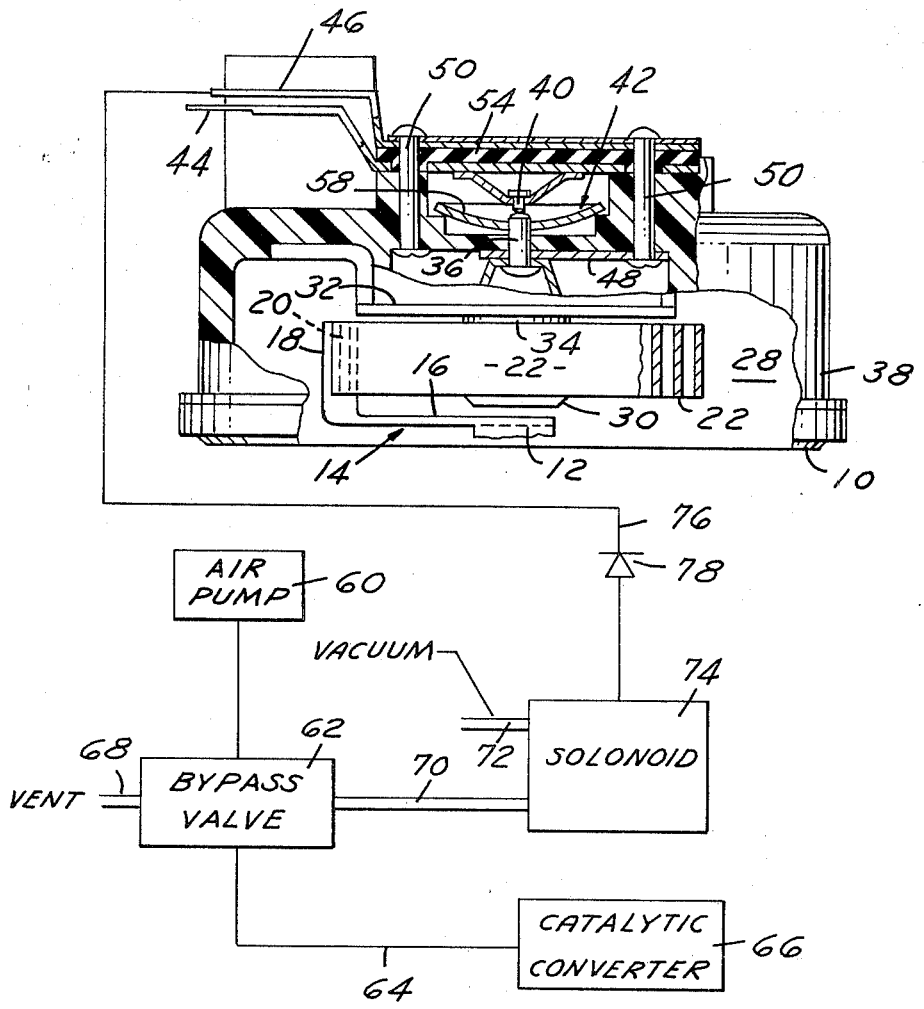
46
50
54
40
42
44
58
50
36
48
32
20
18
34
16
-22-
28
38
30
22
14
12
10
76
78
AIR PUMP
60
VACUUM
74
62
68
72
SOLONOID
70
VENT
BYPASS VALVE
CATALYTIC CONVERTER
66
64

CATALYST OVER TEMPERATURE PROTECTOR

This invention relates in general to a system for controlling the operation of an automotive type gas conversion device, such as, for example, a catalytic converter. More particularly, it relates to correlation of the operation of such a catalytic converter with the operation of the conventional engine carburetor automatic choke mechanism.

Automotive type engines generally utilize an automatic choke mechanism attached to the carburetor for the start up of a cold engine. This mechanism conventionally includes a choke valve that is pivotally movable to a closed position by a temperature responsive coiled spring element to restrict the induction passage of the carburetor. This results in the induction of a rich enough air/fuel ratio mixture to maintain a cold engine running.

When such an engine system includes a catalytic converter or the like for the conversion of unburned hydrocarbons and other undesirable elements, air usually is supplied to the catalytic converter for the thermal reaction. However, when a cold engine operates over an extended period of time with a rich air/fuel mixture, the converter reaction may cause an excessive temperature rise with a resultant burnout of the converter. To protect against this, devices and systems have been designed to control the temperature level in a number of ways; for example, by cutting off the supply of air to the converter to terminate the thermal reaction; by controlling the supply of fuel to accomplish the same purpose; or, by bypassing the exhaust products around the catalytic converter until the excess temperature level is reduced.

Devices are known in the prior art for providing the above controls. For example, Radin, U.S. Pat. No. 3,812,401, shows an electronic circuit for controlling the supply of air to a catalytic converter when the converter temperature rises above a predetermined level.

Masaki et al, U.S. Pat. No. 4,023,359, also shows an electronic control means for terminating the flow of secondary air to the exhaust system when the temperature of the catalytic converter or reactor rises above a critical value, and specifically mentions that this may occur when the choke valve remains inadvertently closed for a long time.

Tamazawa et al, U.S. Pat. No. 4,026,106, also shows an overheat protection device for a catalytic converter in which the secondary air input is diverted when the catalytic converter temperature is higher than a desired level.

Masaka et al, U.S. Pat. No. 4,123,901, shows a construction in which reaching a temperature level in the thermal reactor above a desired point actuates a solenoid air bleed valve to change the air/fuel ratio to protect the thermal reactor.

Eichler et al, U.S. Pat. No. 3,949,551, shows a system controlling fuel flow during engine starting to provide a richer mixture, which subsequently is decreased in dependence upon exhaust system temperature.

Barnard, U.S. Pat. No. 4,117,807, shows an electronic circuit for detecting misfire of spark plugs that would result in excessive exhaust gas temperature levels, the system controlling the fuel injection to prevent such excess temperatures.

It will be noted from a consideration of the above prior art that in most instances, the overprotection system or device is dependent upon the temperature of the catalytic converter or thermal reactor, and is not directly related to the operation of the carburetor choke mechanism. In connection with this, the conventional choke mechanism generally effects an opening of the choke valve as the rising ambient temperature warms the thermostatic spring. As the choke valve opens, therefore, the air flow into the carburetor increases, which reduces the fuel flow signal so that a leaner air/fuel mixture results. It is important, therefore, that there be a direct tie-in between the opening of the choke valve and the admission of air to the catalytic converter to permit operation of the converter at its normal operating temperature level with the engine air/fuel mixture charge leaner than during the starting and warm-up operation.

Accordingly, it is a primary object of this invention to provide a system for controlling the operation of the catalytic converter that is directly related to the operation of the engine carburetor automatic choke mechanism so that supplemental air supplied to the converter to provide the thermal reaction will not occur until the choke valve is ready to move to an open position.

In some automotive installations, the automatic choke mechanism includes a heater that is energized when a bimetallic switch means reaches a predetermined ambient temperature level to supply heat to the automatic choke thermostatic spring means. This causes it to unwind faster than it would normally unwind were it subject to the changes in ambient temperature level alone. This is desirable because the characteristics of the bimetallic spring generally cause the choke valve to remain on longer than is desirable. This is, the warm-up time of the thermostatic spring and the engine do not necessarily coincide so that the engine may reach its normal operating temperature sooner than the thermostatic spring unwinds. This would lead to the supply of a rich air/fuel mixture charge to the engine beyond the time when it is needed to maintain a cold engine running. As a solution, the heater means is activated at a predetermined ambient temperature level that generally is lower than the level when the thermostatic spring means would normally open the valve.

It is another object of the invention, therefore, to correlate the supplying of secondary air to a catalytic converter in accordance with opening of the choke valve in response to operation of an electrically controlled heater means.

It is a still further object of the invention to provide a system as described above in which the attainment of a predetermined ambient temperature level at the choke assembly actuates a bimetallic switch means to electrically connect the engine driven alternator both to a heater means and to an electrically controlled valve means so that the valve means thereafter will supply secondary air to a catalytic converter at the same time the choke valve is opening in response to operation of the heater means.

Other objects, features, and advantages of the invention will become more apparent upon reference to the succeeding detailed description thereof, and to the drawing illustrating the preferred embodiment thereof; wherein the FIGURE illustrates schematically the system embodying the invention.

The upper portion of the FIGURE is a cross-sectional view of a portion of the automatic choke mechanism that normally is attached to one side of a conventional automotive type downdraft carburetor, not shown. Such a carburetor is shown and described in Hollins, U.S. Pat. No. 4,050,427, assigned to the assignee of this invention. The details of construction and operation of the carburetor, therefore, are not given since they are believed to be unnecessary for an understanding of this invention.

The automatic choke mechanism per se includes a housing portion 10 that normally is formed as an extension of the carburetor throttle mounting flange, not shown. The housing is apertured for rotatably supporting one end 12 of a choke level operating shaft that is operable connected to the carburetor choke valve, not shown. The choke valve would be rotatably mounted in the carburetor induction passage, as clearly shown in U.S. Pat. No. 4,050,427. Rotation of the choke valve would occur in one direction by rotation of shaft 12 alone, in a manner to be described, or in the other direction by rotation of shaft 12 in conjunction with the flow of air through the carburetor induction passage against the choke valve.

An essentially L-shaped thermostatic spring lever 14 has a leg 16 fixedly secured to the shaft 12. The other leg portion 18 is secured to the outer end 20 of a coiled bimetallic thermostatic spring element 22. The casing would be provided with a hot air passage, not shown, connected in the usual manner to an exhaust manifold heat stove, for example. Under the influence of the hot air in the passage described, the thermostatic spring element 22 will expand or contract as a function of the changes in the ambient temperature conditions of the air entering the hot air passage, or, if there is no flow, the temperature of the air within the chamber 28 surrounding the spring element 22. According, changes in ambient temperature will rotate the spring lever 14 to rotate shaft 12 and the choke valve in one or the other directions, as the case may be, to control the operation of the choke valve.

A cold weather start of a motor vehicle requires a richer mixture than a warmed engine start because considerably less fuel is vaporized. Therefore, during a cold start, the choke valve is shut or nearly shut to increase the pressure drop thereacross and draw in more fuel. Once the engine has started, the exhaust manifold stove air in the hot air passage will progressively warm and cause the thermostatic element 22 to unwind slowly and rotate shaft 12 and the choke valve to more open positions.

In addition to the above conventional operation, as stated above, an electrical heater means sometimes is incorporated adjacent thermostatic element 22 to become operable above a predetermined ambient temperature level to apply heat to the thermostat to cause the choke valve to open or come off sooner than it would were it subject to the characteristics of the thermostatic element 22 alone. This is done for emission control purposes to reduce the time that the engine is operating under a rich air/fuel ratio mixture to only that that is needed.

As seen in the FIGURE, the thermostatically coiled spring 22 is centrally staked to a metal post 30. The post is formed as an integral part of a thin metal, aluminum, for example, disc 32 that is approximately the diameter of the coil 22. The disc constitutes a heat sink or transfer member to evenly radiate heat to the coil from a heater element 34 to which it is secured.

Heater element 34 in this case is a positive temperature coefficient (PTC) semiconductor in the shape of a flat ceramic disc. It is fixed on disc 32 and has a central spring leg type current carrying contact lug 36 projecting through an insulated cover or choke cap 38. The heat sink disc is suitably grounded, by means not shown, through the cover by extensions and ground terminals. Lug 36 normally is spaced from a current carrying power input contact 40 fixed on a bimetallic thermal switch 42. The latter is operative in response to changes in ambient temperature. The switch is of the Belleville spring, flip-flop type and closes to the position shown above 65° F., for example, to engage the two contacts 40 and 36. This will then conduct current to the PTC heater 34 from a power input terminal 44. The vehicle alternator could serve as a suitable source of electrical energy to terminal 44 when the vehicle is running. The output side of the switch 42 including lug 36 is connected to a signal terminal 46 through a bar 48 and current carrying pins 50. An insulator 54 is located between the power and signal terminals 44 and 46, as shown.

It will be clear that when the ambient temperature is below a predetermined level, the Belleville-like spring element 58 of the switch means 42 will assume a convex attitude opposite to that shown in the FIGURE. This results in a pushing upwardly of contact 40 to separate it from contact 36 and break the circuit from power input terminal 44 to the PTC heater disc 34. As the engine warms, and the design ambient temperature level is reached, which will be lower than the ambient temperature level at which the thermostatic coil 22 normally would fully open the choke valve, the Belleville-like spring element 58 will move overcenter to the position shown in the FIGURE permitting the spring legs of contact lug 40 to move it downwardly to the position shown to make contact with contact lug 36 and thereby complete the circuit from the alternator through the power input terminal 44 to the PTC heater element 34.

The details of construction and operation of the PTC heater are more fully shown and described in U.S. Pat. No. 4,050,427, assigned to the assignee of this invention. As described therein, it is an inherent property of PTC semiconductor 34 to obtain a very high impedance to current flow at high internal temperatures, and that the semiconductor has an ability to maintain a high maximum temperature. The need for a cutoff thermostat to protect against distortion of bimetallic coil 22, therefore, due to extreme temperature levels, is thereby eliminated.

In this instance, therefore, the PTC device provides heat to coil 22 that is supplemental to that provided by the primary exhaust manifold hot air system. When the bimetal switch 42 closes and current passes through the PTC element, a change in the internal temperature is noticed. The heat generated is transferred by conduction to coil 22 through the post 30 and by radiation to the coil from the heat sink 32. The energized PTC heater therefore acts to effect a rapid opening of the choke valve by unwinding the coil 22 and decreasing its resistance to flow of air against the choke valve through the carburetor opening.

Turning now to the gas conversion device, i.e., the catalytic converter, the FIGURE illustrates schematically an air pump 60 that would be driven by the engine to provide a source of secondary air for exhaust emission purposes, in a well-known manner. One of these purposes is to supply air to the catalytic converter to provide the oxygen necessary for thermal reaction in the converter. This is accomplished by passing the air through an air bypass valve 62 and therefrom through a line 64 to catalytic converter 66. The bypass valve 62 in this case permits passage of the air either to the converter, or through a vent line 68. The bypass valve 62 generally is vacuum operated between its positions. When vacuum is applied through a line 70 to the bypass valve, the valve will move to vent the air from the air pump through the vent line 68 and prevent air flow through line 64 to converter 66.

The details of construction and operation of the bypass valve are known and are not given since they are believed to be unnecessary for an understanding of the invention. For example, such details are clearly shown and described in U.S. Pat. No. 3,433,242, Voorheis, assigned to the assignee of this invention.

In this case, supply of vacuum from a line 72 to line 70 connected to the bypass valve 62 is controlled by a normally open solenoid controlled valve indicated at 74. In the normal state of valve 74, the vacuum line 72 would be connected to line 70 thereby blocking the flow of secondary air to converter 66. The source of vacuum to line 72 may be any suitable source, such as, for example, the intake manifold vacuum, or a reservoir at a constant vacuum level.

Solenoid 74 is controlled electrically by a signal from the choke signal terminal 46 when the ambient temperature switch means 42 becomes operative. That is, when the switch means 58 flops overcenter to connect lugs 40 and 36 and power input terminal 44 to signal terminal 46, the AC signal emanating from the alternator of the engine will be connected through line 76 to solenoid 74. A rectifier 78 with a biased input could be provided to smooth out the AC current to DC. The electrical signal from terminal 46 would, therefore, activate or render operable solenoid 74 to move its valve to its closed state disconnecting line 72 from line 70. This then causes bypass valve 62 to move to an open position connecting the secondary air from air pump 60 through line 64 to the catalytic converter 66 to permit normal thermal reaction. The bypass vent line 78 would then be blocked.

From the above, it will be clear that the invention provides a direct correlation between the operation of the choke valve of the carburetor and the catalytic converter or gas conversion device in that secondary air is prevented from being supplied to the converter until the choke valve has begun to move to its open position in response to operation of the auxillary heater means.

While the invention has been shown and described in its preferred embodiment, it will be clear to those skilled in the arts to which it pertains that many changes and modifications may be made thereto without departing from the scope of the invention. For example, the signal terminal 46 could be connected to the input of a microprocessor unit instead of to the solenoid 74 shown in the drawing. Then, when the thermostatic switch means supplies current to the heater means and to the signal terminal, this could be used as a binary signal to allow the microprocessor to control, for example, a feedback carburetor open loop-closed loop control, engine spark advance modification, or exhaust gas recirculation.

I claim:

1. A system for controlling the operation of an exhaust gas conversion device for use with an engine having a carburetor having a temperature responsive choke valve operably movable from a closed to open positions in response to the attainment of ambient temperatures above a predetermined level, electrically activated heater means operably associated with the choke valve when operable effecting opening of the choke valve at an ambient temperature level lower than the predetermined level, an ambient temperature responsive bimetallic on-off switch means operable at the lower temperature level to connect a source of electrical energy to the heater means to activate the same, the engine including an engine driven air pump providing a source of air, the system including electrically actuated control means for controlling the operation of the gas conversion device, the control means including means operable upon activation of the heater means to connect the source of air to the gas conversion device.

2. A system as in claim 1, the switch means including a power input terminal connected to the power input side of the switch means, and an electrical signal terminal connected to the other power output side of the switch means and connected to the source of power only when the switch means is closed.

3. A system as in claim 1, the heater means comprising a positive temperature coefficient (PTC) transducer having the characterisics of a self-limiting output temperature level operable to transfer heat up to the limiting level.

4. A system as in claim 1, the control means including an air bypass valve operable in one position to direct air to the gas conversion device and in another position to block the flow of air, a source of engine vacuum, vacuum operated means for moving the bypass valve, and solenoid valve means operably controlling the supply of vacuum to the bypass valve for moving the bypass valve in response to operation of the heater means to connect air to the gas conversion device.

5. A system as in claim 4, including means connecting the power terminal to the engine alternator, and rectifier means between the signal terminal and the solenoid means to provide a smooth contant source of direct current to the solenoid means.

* * * * *